US005607081A

United States Patent [19]

Levy

[11] Patent Number: 5,607,081

[45] Date of Patent: Mar. 4, 1997

[54] CLEANING ASSEMBLY

[76] Inventor: David Levy, 17 Daphna Street, Yavne 81510, Israel

[21] Appl. No.: 310,145

[22] Filed: Sep. 21, 1994

[30] Foreign Application Priority Data

Sep. 21, 1993 [IL] Israel ..... 107060

[51] Int. Cl.[6] ..... B67D 5/00

[52] U.S. Cl. ..... 222/83.5; 15/104.93; 15/104.94; 206/210; 206/494; 206/812; 222/88; 222/93; 222/106; 222/192

[58] Field of Search ..... 222/80, 81, 83, 222/83.5, 88, 93, 106, 192; 206/210, 494, 812; 15/104.93, 104.94

[56] References Cited

U.S. PATENT DOCUMENTS

| | | | |
|---|---|---|---|
| 2,841,147 | 7/1958 | McLaurin | 128/275 |
| 2,925,084 | 2/1960 | Brewer | 128/251 |
| 3,054,403 | 9/1962 | Baker | 128/232 |
| 3,057,352 | 10/1962 | McKenna | 128/248 |
| 3,144,866 | 8/1964 | Ellis | 128/232 |
| 3,252,634 | 5/1966 | Scholle | 222/514 |
| 3,276,632 | 10/1966 | Stanzel | 222/83.5 |
| 3,293,683 | 12/1966 | Wyant | 15/104.93 |
| 3,337,117 | 8/1967 | Lehmacher et al. | 229/62.5 |
| 3,401,695 | 9/1968 | Rosenberg et al. | 128/232 |
| 3,545,604 | 12/1970 | Gunther, Jr. et al. | 206/47 |
| 3,596,801 | 8/1971 | Barnack | 222/81 |
| 3,896,807 | 7/1975 | Buchalter | 128/261 |
| 4,159,718 | 7/1979 | Bower | 128/248 |
| 4,437,567 | 3/1984 | Jeng | 206/210 |
| 4,475,670 | 10/1984 | Rutter | 222/83 |
| 4,484,904 | 11/1984 | Fowler | 493/213 |
| 4,723,956 | 2/1988 | Schnell et al. | 604/414 |
| 4,796,751 | 1/1989 | Madkour | 206/812 X |
| 4,798,605 | 1/1989 | Stener et al. | 222/83 X |
| 4,925,453 | 5/1990 | Kannankeril | 15/104.94 X |
| 4,959,881 | 10/1990 | Murray | 15/104.94 X |
| 5,006,339 | 4/1991 | Bargery et al. | 424/404 |
| 5,083,337 | 1/1992 | Jones | 15/104.94 |
| 5,111,934 | 5/1992 | Morin | 206/229 |
| 5,330,075 | 7/1994 | Brown, Sr. | 222/106 X |

FOREIGN PATENT DOCUMENTS

| | | | |
|---|---|---|---|
| 0322980 | 7/1989 | European Pat. Off. | 222/83 |
| 404744 | 12/1909 | France . | |
| 861063 | 2/1961 | United Kingdom . | |
| 93/14986 | 8/1993 | WIPO . | |

*Primary Examiner*—Joseph Kaufman
*Attorney, Agent, or Firm*—Wolf, Greenfield & Sacks, P.C.

[57] ABSTRACT

This invention discloses a cleaning assembly comprising a wet tissue, a liquid impermeable packet containing the wet tissue and a dry liquid absorbent tissue mounted onto the liquid impermeable packet.

14 Claims, 5 Drawing Sheets

CLEANING ASSEMBLY

FIELD OF THE INVENTION

The present invention relates to cleansing apparatus generally.

BACKGROUND OF THE INVENTION

Various types of cleansing apparatus are known. The following U.S. Pat. Nos. are believed to be representative of the most relevant prior art: 2,841,147; 2,925,084; 3,054,403; 3,144,866; 3,337,117; 3,401,695; 3,545,604; 3,896,807; 4,159,718; 4,484,904; 4,723,956; 5,006,339.

SUMMARY OF THE INVENTION

The present invention seeks to provide an improved cleaning assembly and an improved liquid storage and dispensing assembly.

There is thus provided in accordance with a preferred embodiment of the present invention a cleaning assembly including:

a wet tissue;

a liquid impermeable packet containing the wet tissue; and a dry liquid absorbent tissue mounted onto the liquid impermeable packet.

There is also provided in accordance with a preferred embodiment of the present invention a cleaning assembly including:

a cleansing liquid;

a liquid impermeable packet containing the cleansing liquid;

a movable nozzle element selectably extendible from the liquid impermeable packet; and a dry liquid absorbent tissue mounted onto the liquid impermeable packet.

There is also provided in accordance with a preferred embodiment of the present invention a cleaning assembly including:

a cleansing liquid;

a liquid impermeable packet containing the cleansing liquid, the liquid impermeable packet lying generally in a plane; and a movable nozzle element selectably extendible from the liquid impermeable packet in a direction generally coplanar therewith.

Preferably the liquid impermeable packet is generally elongate and extends along a longitudinal axis and the movable nozzle element extends perpendicular to the longitudinal axis.

In accordance with a preferred embodiment of the present invention, the movable nozzle element is integrally formed with a spring.

Preferably the assembly also includes a retractable piercing element which is located within the movable nozzle element.

Additionally in accordance with a preferred embodiment of the present invention, the assembly also includes a wet tissue located within the liquid impermeable package.

Further in accordance with a preferred embodiment of the present invention, the assembly also includes a dry liquid absorbent tissue mounted onto the liquid impermeable packet.

Preferably, the dry liquid absorbent tissue includes a multiple ply tissue whose plys are separable and separately foldable.

Additionally in accordance with a preferred embodiment of the present invention, the packet serves as a liquid impermeable backing for the dry liquid absorbent tissue during use thereof.

Further in accordance with a preferred embodiment of the present invention, there is provided a dispensing liquid container including:

a liquid-impermeable container; and a self-piercing nozzle assembly disposed within the liquid impermeable container and including:

a nozzle element integrally formed with a spring.

Preferably, the self-piercing nozzle assembly also includes a piercing element disposed inside the nozzle assembly.

In accordance with a preferred embodiment of the present invention, the integrally formed spring includes a compression spring.

Preferably the self-piercing nozzle assembly has two operative orientations:

uncompressed within the packet, and compressed for operation of the piercing element.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Reference is now made to FIGS. 1A–3D, which illustrate a cleaning assembly constructed and operative in accordance with a preferred embodiment of the present invention. The cleaning assembly preferably comprises a liquid impermeable enclosure 10, typically formed as a sleeve which is heat sealed along lines 12, 13 and 14 and is provided with a tear start notch 16 at one end thereof.

Figure 1A:
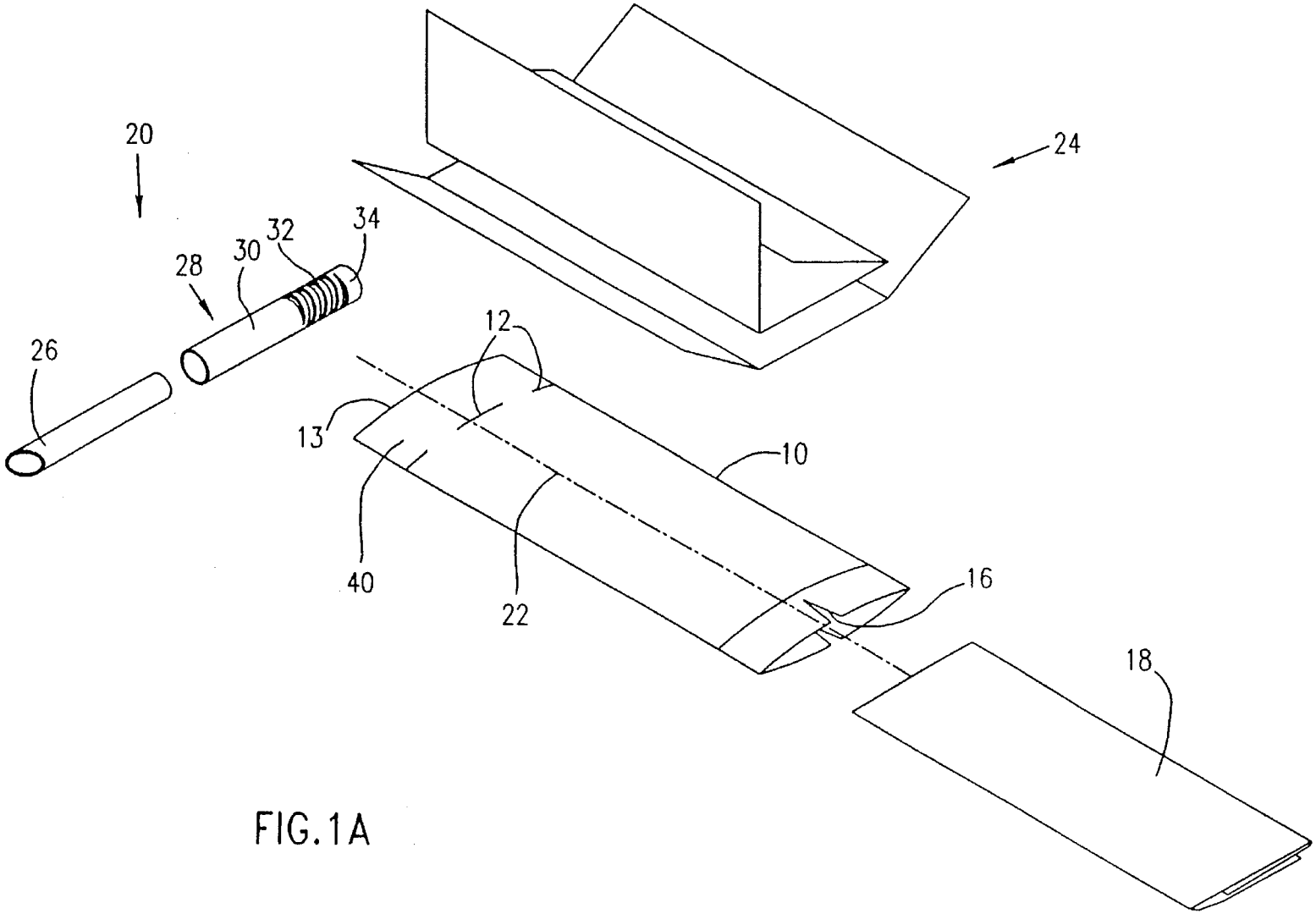
FIGS. 1A, 1B, 1C and 1D illustrate an intimate cleaning assembly in respective exploded view, partially disassembled and fully assembled orientations.
Figures 1B, 1C, 1D:
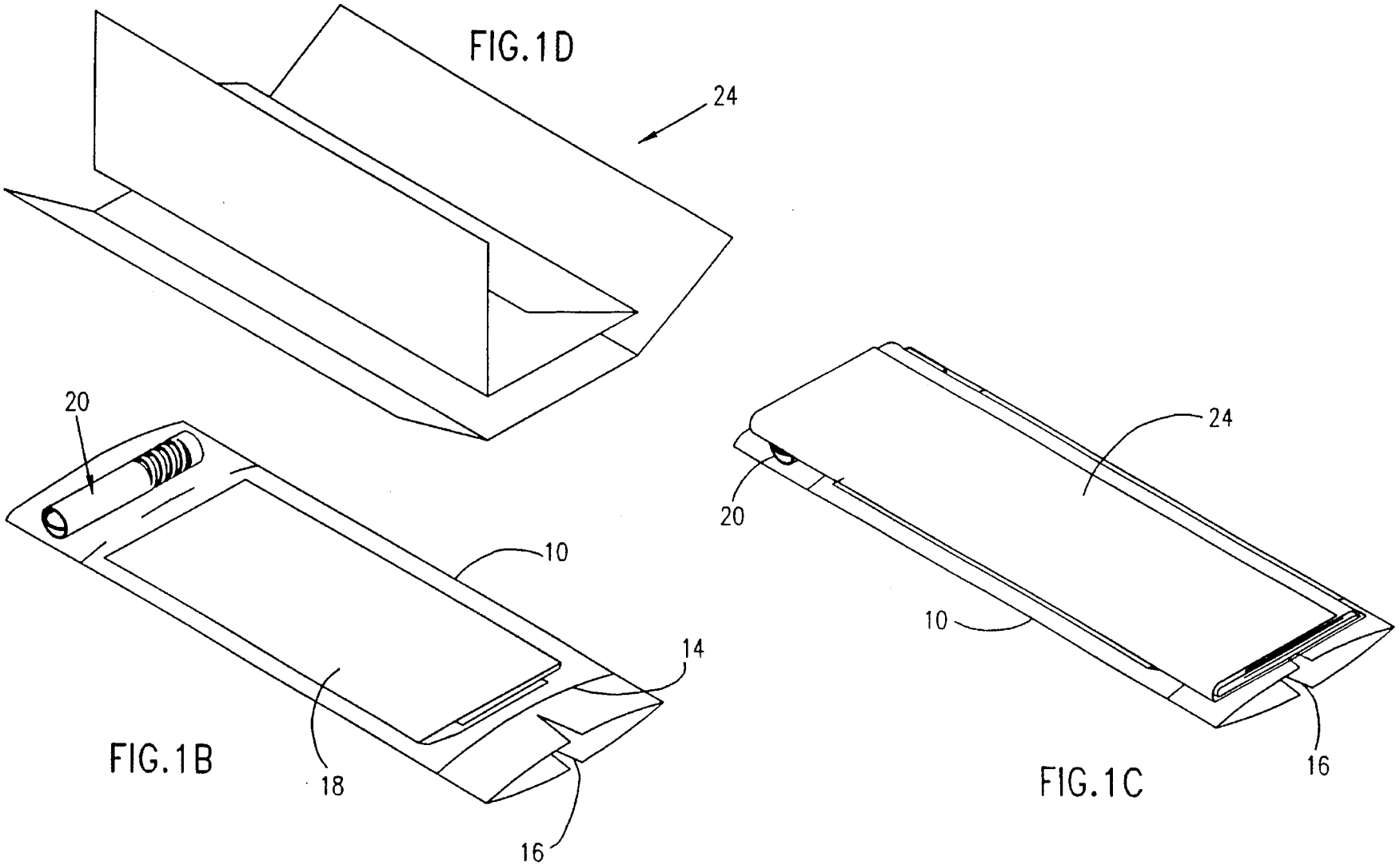

The heat seals along lines 13 and 14 are complete and define liquid impermeable seals, while the heat seal along line 12 is partial and allows the flow of liquid therepast. Thus, between the partial seal 12 and the edge 13 of the enclosure 10, a pocket 40 is formed. A nozzle assembly 20 is inserted into the pocket 40, as shown in FIG. 1B. The purpose of the pocket 40 is to retain the nozzle assembly 20 within the upper section of the enclosure 10 without restricting its movement therewithin.

In accordance with another preferred embodiment of the present invention, the nozzle assembly 20 is placed within an envelope (not shown) made of such material as plastic sheet. The envelope includes a plurality of orifices in the base thereof and placed in the pocket 40 such that the orifices face the partial seal line 12.

Disposed within enclosure 10 between lines 12 and 14 is a supply of disinfecting or otherwise cleansing liquid as well as a wet tissue 18, preferably impregnated with such liquid.

In accordance with a preferred embodiment of the present invention, disposed between sealing lines 12 and 13 is a nozzle assembly for permitting ejection of the cleaning liquid from inside enclosure 10 in a transverse direction relative to the elongate axis 22 of the enclosure, so as to enable the liquid to be readily sprayed into a body cavity.

Additionally in accordance with a preferred embodiment of the present invention, a multiple ply wiping tissue 24 is preferably attached to one flat surface of enclosure 10, such that the enclosure 10 can serve as a liquid impermeable backing and support for the wiping tissue 24 (FIG. 1D). One or more of the plys of tissue 24 may be removable from engagement with enclosure 10.

Nozzle assembly 20 preferably includes a pointed piercing portion 26 and a nozzle portion 28. The nozzle portion 28 is preferably injection molded as one piece and includes a hollow cylindrical portion 30 joined by an integral spring 32 to an end portion 34. Piercing portion 26 is normally seated within cylindrical portion 30 and spring 32, as seen in FIG. 1B. The nozzle assembly 20 is placed in the pocket 40, as illustrated in FIG. 1B.

Figure 2:
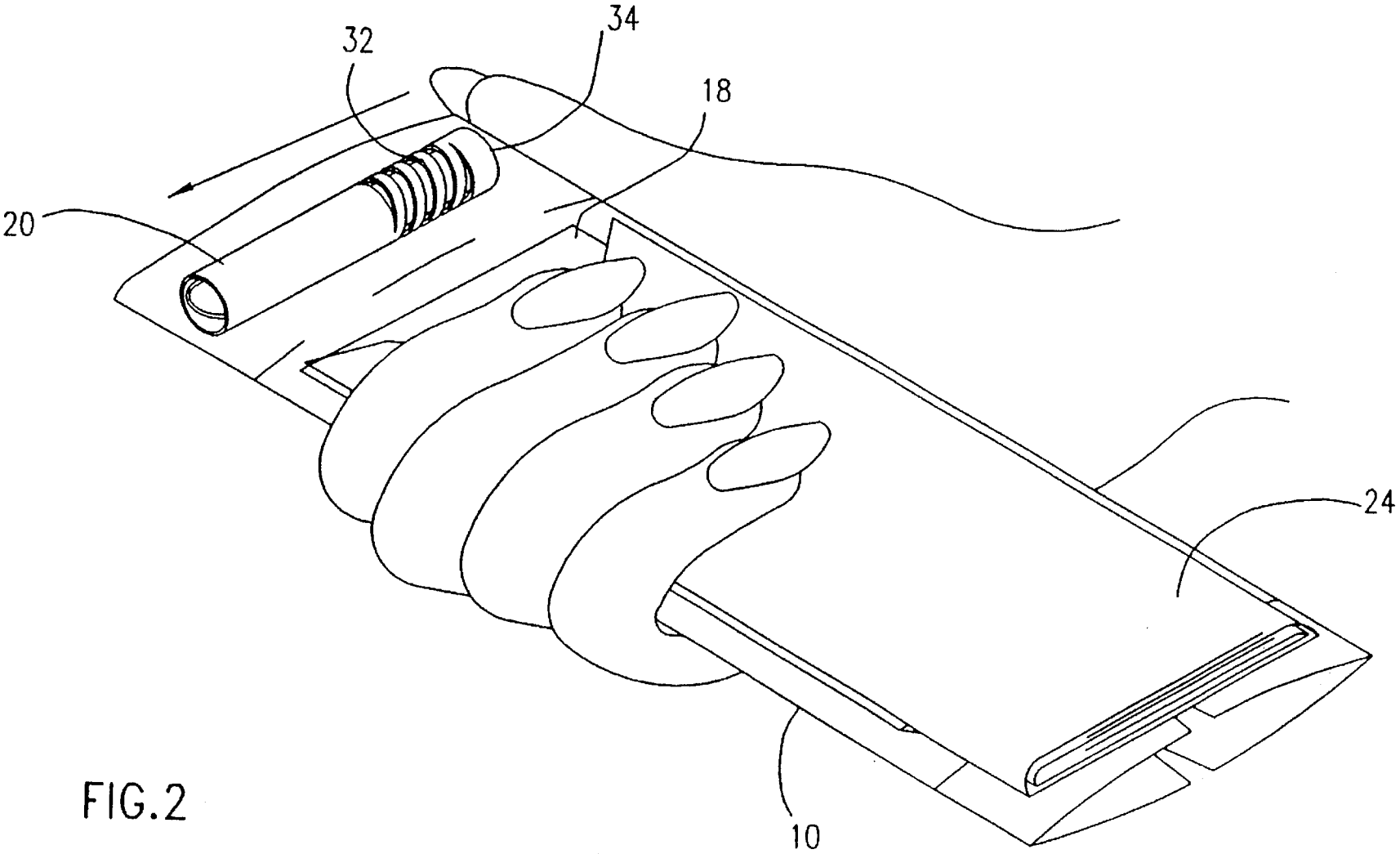
FIG. 2 illustrates a user of the cleaning assembly holding the apparatus.

A preferred embodiment of the present invention, held in the hand of a user, is illustrated in FIG. 2.

Figure 3A:
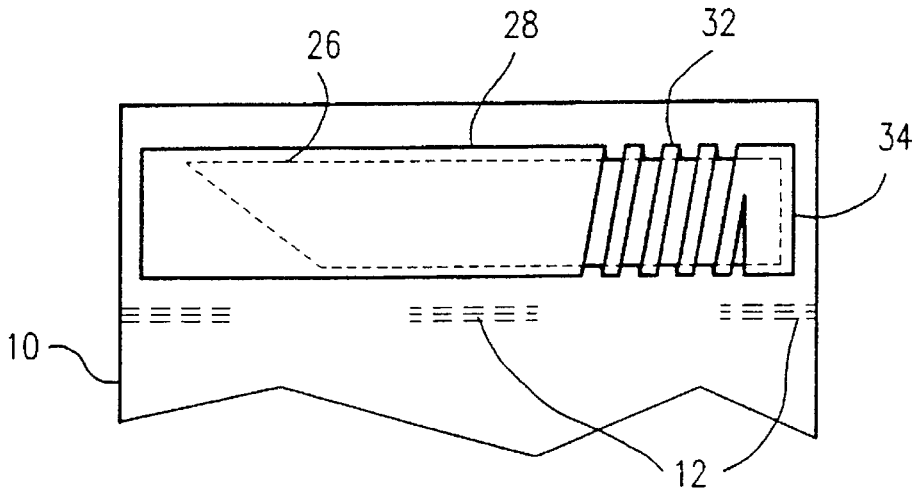
FIGS. 3A and 3B illustrate the nozzle assembly in respective storage and piercing orientations.
Figure 3B:
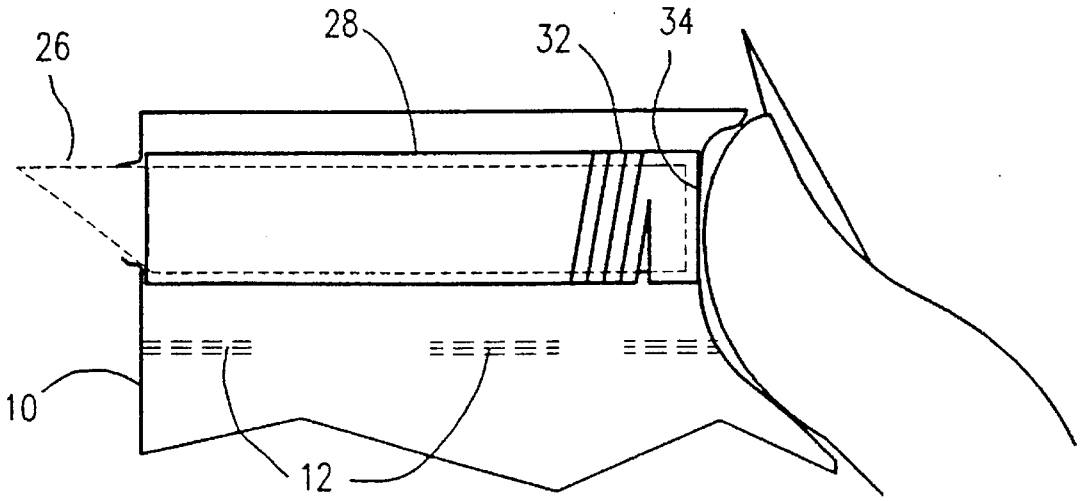
Figure 3C:
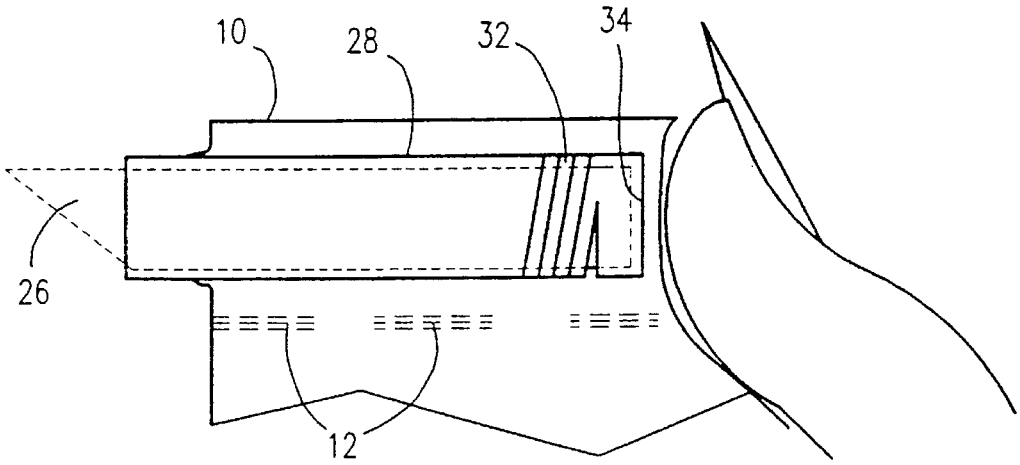
FIGS. 3C and 3D illustrate the nozzle assembly in respective extending and extended orientations.
Figure 3D:
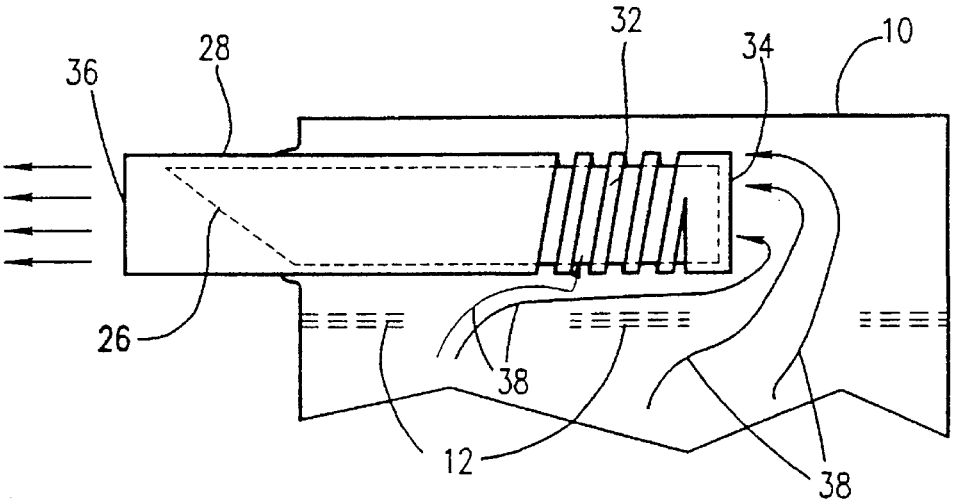

As seen in FIGS. 3A–3D, pushing on end portion 34, as by the thumb of a user, in an axial direction, causes piercing portion 26 to emerge, point first, from cylindrical portion 30 and to pierce the wall of enclosure 10 adjacent thereto. Further pushing on end portion 34 causes the cylindrical portion to extend transversely outwardly of enclosure 10 by a selected distance. Release of the end portion 34 allows the piercing portion 26 to retract within cylindrical portion 30, as seen in FIG. 3D, but allows the cylindrical portion 30 to remain extended through the pierced wall of enclosure 10, as shown.

The cleansing fluid flows through the partial seal 12, as indicated by the arrows 38 and through the opening 36 of the nozzle portion 28.

When used for intimate cleansing or disinfecting, the wet tissue 18 may be used for cleansing a body cavity or other region and the dry tissue 24 may be used for absorbing moisture and drying the cleansed area.

It will be appreciated that the structure of enclosure 10 and nozzle assembly 20 is not limited in its applicability to cleansing and disinfecting, but is also applicable to the storage and dispensing of other liquids, such as medical fluids, cosmetic fluids, soft drinks and foam. For these purposes, a preferred embodiment of the present invention does not include the wet tissue 18 and the dry tissue 20.

It will be appreciated by persons skilled in the art that the present invention is not limited by what has been particularly shown and described hereinabove. Rather the scope of the present invention is defined only by the claims which follow:

I claim:

1. A cleaning assembly comprising:

a wet web material element;

a liquid impermeable packet containing said web material element and also containing a cleansing liquid which is not fully absorbed into the wet material element; and an unwrapped dry liquid-absorbent web material element mounted outside of the liquid impermeable packet.

2. A cleaning assembly according to claim 1 and also comprising a nozzle element selectably extendible from said liquid impermeable packet.

3. A cleaning assembly according to claim 2 and wherein said dry liquid-absorbent web material element comprises a multiple ply tissue whose plys are separable and separately foldable.

4. A cleaning assembly according to claim 2 and wherein said packet serves as a liquid impermeable backing for said dry liquid absorbent web material element during use thereof.

5. A cleaning assembly according to claim 1 and wherein said liquid impermeable packet is generally elongate and extends along a longitudinal axis and wherein said nozzle element extends perpendicular to said longitudinal axis.

6. A cleaning assembly according to claim 1 and wherein said dry liquid-absorbent web material element comprises a multiple ply tissue whose plys are separable and separately foldable.

7. A cleaning assembly according to claim 1 and wherein said packet serves as a liquid impermeable backing for said dry liquid absorbent web material element during use thereof.

8. A cleaning assembly comprising:

a wet web material element;

a liquid impermeable packet containing and web material element and also containing a cleansing liquid which is not fully absorbed into the wet material element; and a piercing nozzle selectably displaceable in said liquid impermeable packet.

9. A cleaning assembly according to claim 8 and wherein said liquid impermeable packet is generally elongate and extends along a longitudinal axis and wherein said nozzle element extends perpendicular to said longitudinal axis.

10. A cleaning assembly according to claim 9 and wherein said nozzle element is integrally formed with a spring.

11. A cleaning assembly according to claim 10 and also comprising a retractable piercing element which is located within said nozzle element.

12. A cleaning assembly according to claim 10 and wherein said spring comprises a compression spring.

13. A cleaning assembly according to claim 8 and wherein said liquid impermeable packet includes a pocket disposed between a partial seal formed in the packet and an edge of the packet and said nozzle is disposed in said pocket to retain the nozzle within the pocket without restricting its movement therewithin.

14. A dispensing liquid container comprising:

a liquid-impermeable container;

a self-piercing nozzle assembly disposed within the liquid-impermeable container and including:

a nozzle element integrally formed with a spring; and a hollow piercing element disposed within said nozzle element and arranged such that liquid contained in said container passes through said hollow piercing element; and wherein said liquid-impermeable packet contains a wet web material element and also a cleansing liquid which is not fully absorbed into the wet material element.

* * * * *